US012467441B1

(12) United States Patent
Yang

(10) Patent No.: US 12,467,441 B1
(45) Date of Patent: Nov. 11, 2025

(54) INFLATOR

(71) Applicant: JIAO HSIUNG INDUSTRY CORP., New Taipei (TW)

(72) Inventor: Yung-Hao Yang, New Taipei (TW)

( * ) Notice: Subject to any disclaimer, the term of this patent is extended or adjusted under 35 U.S.C. 154(b) by 0 days.

(21) Appl. No.: 18/809,401

(22) Filed: Aug. 20, 2024

(51) Int. Cl.

| | |
|---|---|
| ***F04B 33/00*** | (2006.01) |
| ***F04B 9/14*** | (2006.01) |
| ***F04B 39/00*** | (2006.01) |
| ***F04B 39/12*** | (2006.01) |

(52) U.S. Cl.
CPC ..... *F04B 33/00* (2013.01); *F04B 9/14* (2013.01); *F04B 39/0022* (2013.01); *F04B 39/123* (2013.01); *Y10T 137/86099* (2015.04)

(58) Field of Classification Search
CPC .... F04B 33/00; F04B 33/005; F04B 39/0016; F04B 39/0022; F04B 39/12; F04B 39/121; F04B 39/123; F04B 9/14; Y10T 137/86099
See application file for complete search history.

(56) References Cited

U.S. PATENT DOCUMENTS

| | | | | |
|---|---|---|---|---|
| 4,932,849 A | 6/1990 | Scheffer | | |
| 5,433,488 A | 7/1995 | Chiago | | |
| 5,775,200 A * | 7/1998 | Tsai | F04B 33/00 | 92/58.1 |
| 6,120,265 A * | 9/2000 | Wu | F04B 33/005 | 417/526 |
| 6,250,343 B1 * | 6/2001 | Chen | F04B 33/00 | 141/38 |
| 2006/0034719 A1 | 2/2006 | Chen | | |

FOREIGN PATENT DOCUMENTS

| | | |
|---|---|---|
| DE | 102014110639 | 11/2015 |
| DE | 102016114562 | 12/2017 |

* cited by examiner

*Primary Examiner* — Loren C Edwards
(74) *Attorney, Agent, or Firm* — patenttm.us

(57) ABSTRACT

An inflator has a tubular housing, an adaptor, a cover, and an inflation mechanism. The tubular housing is made of plastic and has two opposite ends. The adaptor is made of metal and disposed on one of the two opposite ends of the tubular housing. The cover is made of plastic and welded with said one of the two opposite ends of the tubular housing to limit a position of the adaptor. The inflation mechanism is disposed to the interior space and is operable to pump air to flow from the interior space, through the adaptor, and to an exterior of the tubular housing. The cover and the tubular housing welded with each other have a same material, which prevents air leakage due to fracture and stabilizes quality of the inflator.

9 Claims, 9 Drawing Sheets

INFLATOR

BACKGROUND OF THE INVENTION

1. Field of the Invention

The present invention relates to a device for inflation, and particularly to an inflator.

2. Description of Related Art

An inflator is a common device to pump air into a to-be-inflated space by manpower and is configured to inflate tires or different types of balls. With reference to FIGS. 8 and 9, a conventional inflator 90 has a tubular housing 91 and an adaptor 92. The tubular housing 91 forms a space therein for air to flow through, and the adaptor 92 is disposed on an end of the tubular housing 91 and configured for an inflation needle or a hose to be connected thereto for inflation.

In the conventional inflator 90, the tubular housing 91 is made of plastic, and the adaptor 92 is made of metal and is fixed to the tubular housing 91 by welding. However, since the adaptor 92 and the tubular housing 91 welded together are of different materials, where the adaptor 92 and the tubular housing 91 are connected has lower structural strength and is fragile, which may lead to air leakage or other issues. Thereby, quality of the conventional inflator 90 is unstable.

SUMMARY OF THE INVENTION

The main objective of the present invention is to provide an inflator which improves its structural strength, prevents fracture, and stabilize its quality.

The inflator has a tubular housing, an adaptor, a cover, and an inflation mechanism. The tubular housing is made of plastic, has a first end and a second end opposite to each other, and is hollow to form an interior space. The adaptor is made of metal and disposed on the tubular housing. The cover is made of plastic and welded with the tubular housing to limit the adaptor on the first end of the tubular housing. The inflation mechanism is disposed to the interior space and is operable to pump air to flow from the interior space to an exterior of the tubular housing through the adaptor.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
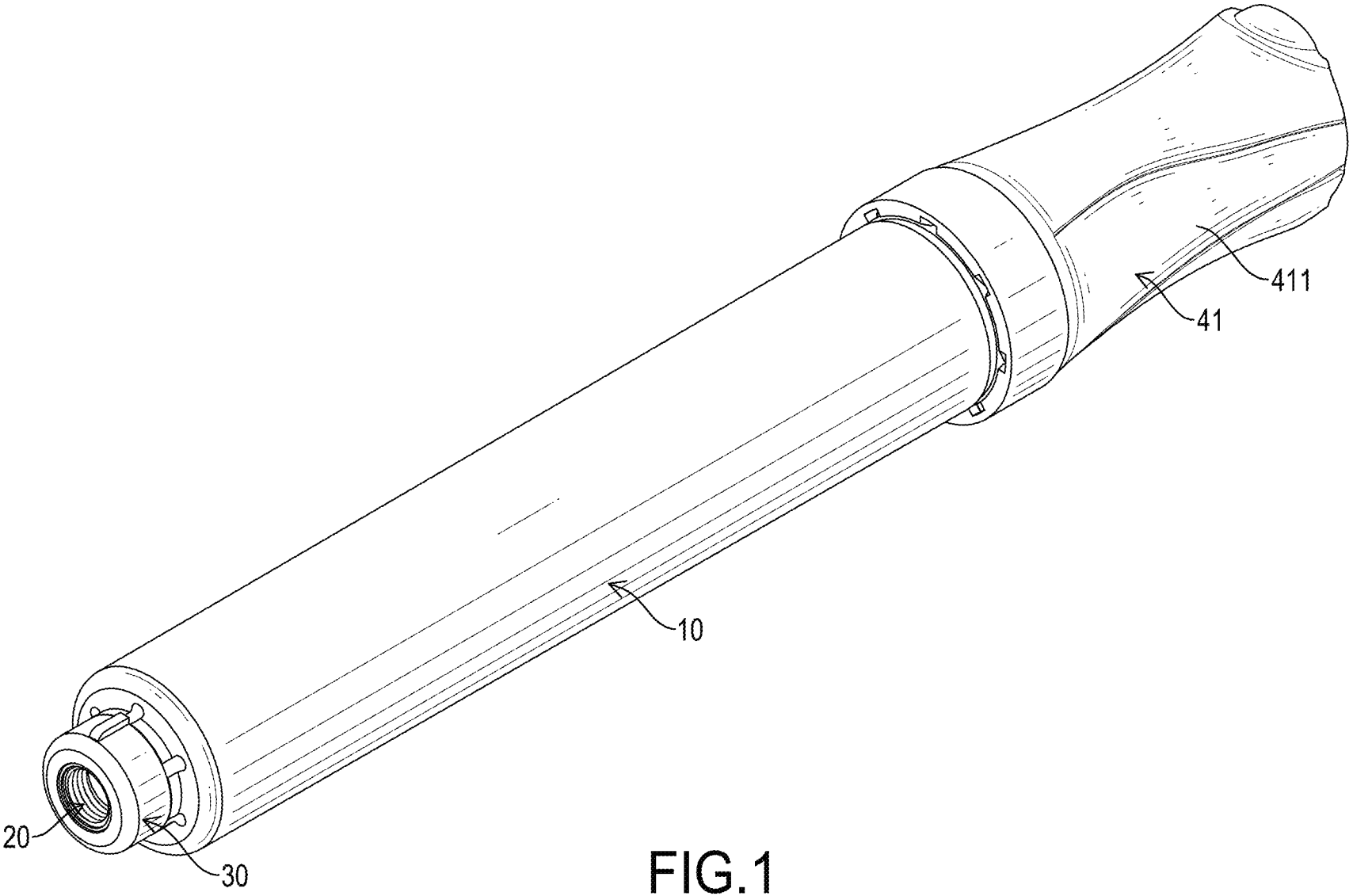
FIG. 1 is a perspective view of a first preferred embodiment of an inflator in accordance with the present invention.
Figure 2:
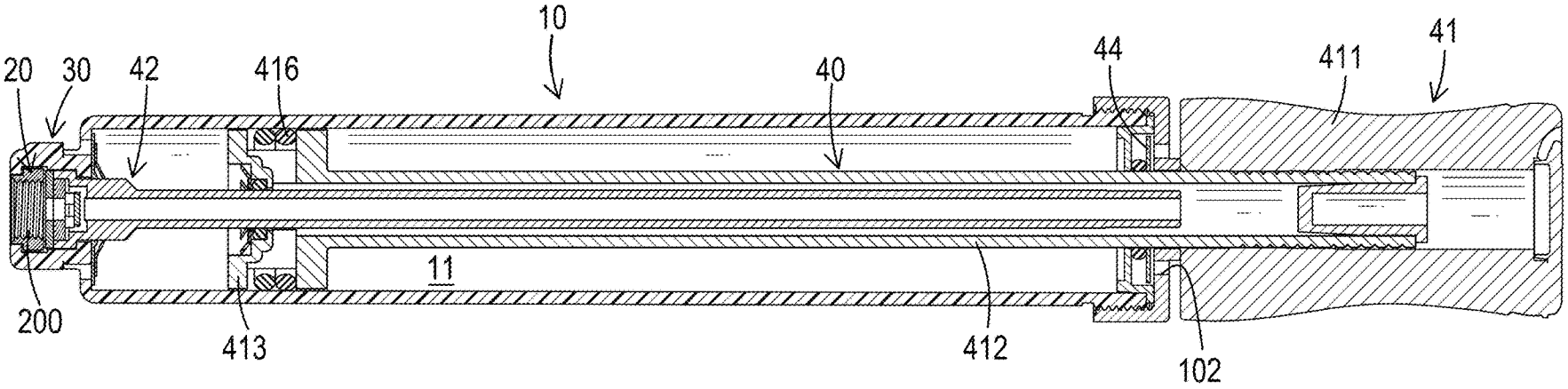
FIG. 2 is a sectional side view of the inflator in FIG. 1.

With reference to FIGS. 1 and 2, a first preferred embodiment of an inflator in accordance with the present invention has a tubular housing 10, an adaptor 20, a cover 30, and an inflation mechanism 40. The adaptor 20 is disposed in the tubular housing 10, and the cover 30 is connected with the tubular housing 10 to limit a position of the adaptor 20. The inflation mechanism 40 is disposed in the tubular housing 10.

The tubular housing 10 is made of plastic. With reference to FIGS. 1 and 2, the tubular housing 10 has a first end and a second end opposite to each other, wherein the first end and the second end are further defined as an output end and an operation end, respectively. The tubular housing 10 is hollow and forms an interior space 11. The adaptor 20 is made of metal and may be any other different type of adaptor according to an object connected thereto, which is not limited to the first preferred embodiment. With reference to FIGS. 1 and 2, the adaptor 20 is disposed on the output end of the tubular housing 10, and the adaptor 20 has a through hole 200 axially defined therethrough. In the first preferred embodiment, the through hole 200 is a threaded hole to be threaded with a valve stem on a tire or an inflation needle for inflation, which provides efficacy of airtightness during inflation.

The cover 30 is made of plastic, and preferably, the cover 30 and the tubular housing 10 may adopt a same material. With reference to FIGS. 1 and 2, the cover 30 is connected with the output end of the tubular housing 10 to limit the adaptor 20 on the output end of the tubular housing 10. Thereby, the adaptor 20 is prevented from departing from the tubular housing 10. Specifically, the cover 30 and the tubular housing 10 are welded with each other. Assembly of the tubular housing 10, the adaptor 20, and the cover 30 is further described in production process of the inflator.

With reference to FIG. 2, the inflation mechanism 40 is disposed to the interior space 11 of the tubular housing 10, wherein a portion of the inflation mechanism 40 protrudes from the operation end of the tubular housing 10 to be operable by a user. The user can change a pressure of the interior space 11 of the tubular housing 10 by operating the inflation mechanism 40 to pump air to flow from the interior space 11, through the adaptor 20 and an inflation component such as a valve stem or an inflation needle connected thereto, and into a to-be-inflated object such as a tire or a ball.

The production processes of the inflator are roughly described below: by forming and processing raw material, the tubular housing 10, the adaptor 20, the cover 30, the inflation mechanism 40, and their components are respectively manufactured and need to be assembled afterwards to accomplish the inflator. When assembling, the inflation mechanism 40 and corresponding components may be placed to the interior space 11 from the operation end of the tubular housing 10 first, and the adaptor 20 and the cover 30 are sequentially placed to the output end of the tubular housing 10 afterwards.

Figure 3:
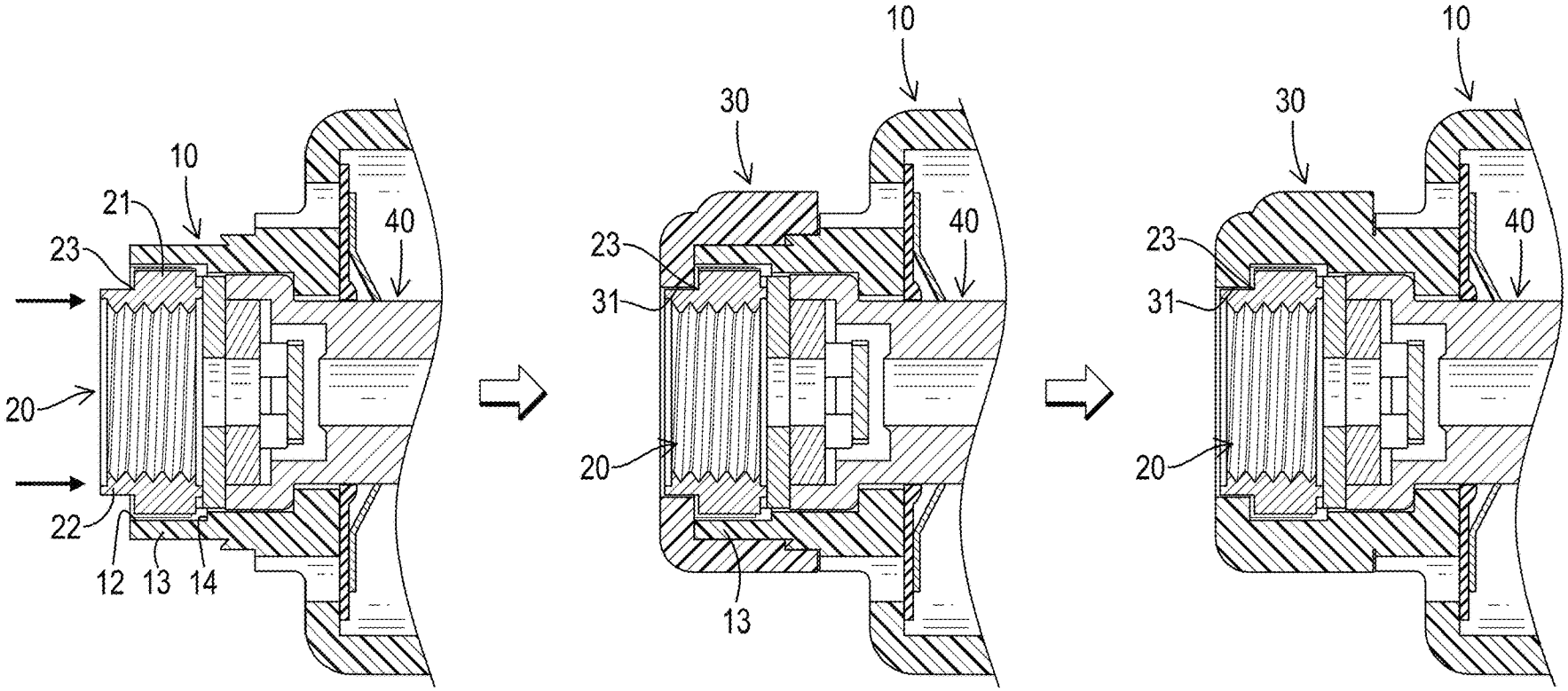
FIG. 3 is an enlarged operational sectional side view of connecting a cover with a tubular housing of the inflator in FIG. 1.

With reference to FIG. 3, the adaptor 20 is first placed to the output end of the tubular housing 10, and the cover 30 is placed to contact the tubular housing 10 and disposed on an outer side of the adaptor 20. The placement is then finished for subsequent processes. In the first preferred embodiment, the adaptor 20 is located between the cover 30 and a spacer of the inflation mechanism 40 to limit its position.

Also, with reference to FIG. 3, in the first preferred embodiment, the tubular housing 10 has an inner edge 14 protruding from an inner wall of the tubular housing 10 and disposed near the output end of the tubular housing 10. If the adaptor 20 and the cover 30 are placed to the output end of the tubular housing 10 before placing the inflation mechanism 40, the adaptor 20 can be located between the cover 30 and the inner edge 14 to limit its position as well. In other embodiments, the inflator may adopt one of the spacer of the inflation mechanism 40 and the inner edge 14 or other structures inside the tubular housing 10 to jointly limit the position of the adaptor 20 with the cover 30.

After the above placement, a welding process is carried out to connect the cover 30 for position-limiting with the output end of the tubular housing 10 by welding such that the cover 30 and the tubular housing 10 are welded with each other in one piece as shown on the right side of FIG. 3. The assembly of the inflator can thus be completed. Specifically, the cover 30 and the tubular housing 10 may be connected with each other via ultrasonic welding. Ultrasonic welding is efficient and low-cost, and allows products to have high quality, high strength, and smooth appearance and to exactly achieve airtightness. In other embodiments, the cover 30 and the tubular housing 10 may be connected with each other via other welding method for plastic.

Compared to the conventional inflator 90 directly welding the metal adaptor 92 with the plastic tubular housing 91, the present invention adopts the cover 30 made of plastic to be welded with the tubular housing 10 made of plastic so as to limit the adaptor 20 on an end of the tubular housing 10, which prevents welded portions of the cover 30 and the tubular housing 10 from problems of low structural strength and air leakage due to fragility caused by welding two different materials together. Thereby, the present invention provides an inflator having sufficient structural strength, reducing possibility of air leakage, and having stable product quality.

Further, with reference to FIG. 3, in the first preferred embodiment, the adaptor 20 has a first cylindrical post portion 21 and a second cylindrical post portion 22. The first cylindrical post portion 21 and the second cylindrical post portion 22 are arranged along an axial direction of the adaptor 20 and connected to each other. The first cylindrical post portion 21 and the second cylindrical post portion 22 are annular and surround the through hole 200. The first cylindrical post portion 21 has an outer diameter larger than an outer diameter of the second cylindrical post portion 22 such that the adaptor 20 forms a stepped structure 23 on its periphery.

The cover 30 has an opening 31 having a diameter smaller than the outer diameter of the first cylindrical post portion 21 and larger than the outer diameter of the second cylindrical post portion 22. The cover 30 is disposed on the stepped structure 23 such that the second cylindrical post portion 22 is inserted in the opening 31 of the cover 30 and the first cylindrical post portion 21 is limited in the tubular housing 10 by the cover 30.

By the first cylindrical post portion 21 and the second cylindrical post portion 22 having different outer diameters and the cover 30 with the opening 31 for the second cylindrical post portion 22 to be inserted therein, when connecting the inflation component such as an inflation needle with the adapter 20, the inflation component can be connected with the adapter 20 through the opening 31 without interference. Thereby, design of the cover 30 does not cause difficulties in operation of inflation.

Moreover, with reference to FIG. 3, the tubular housing 10 forms a tubular housing opening 12 and an annular wall 13 surrounding the tubular housing opening 12 on the output end of the tubular housing 10. The first cylindrical post portion 21 is disposed in the tubular housing 10 and surrounded by the annular wall 13; i.e., a diameter of the tubular housing opening 12 is larger than the outer diameter of the first cylindrical post portion 21. The second cylindrical post portion 22 protrudes from the tubular housing opening 12 to be inserted in the opening 31 of the cover 30 as described above.

With reference to the left side of FIG. 3, when assembling the inflator, the adapter 20 can be placed in the tubular housing 10 from the tubular housing opening 12 first such that the first cylindrical post portion 21 is surrounded by the annular wall 13 to be stably placed on the output end of the tubular housing 10, and then the cover 30 is connected with the tubular housing 10 to limit the first cylindrical post portion 21 on the output end of the tubular housing 10. Operation of assembly is simple and convenient, and production efficiency can thus be improved.

Preferably, with reference to the middle and the right side of FIG. 3, the cover 30 is sheathed onto the annular wall 13 of the tubular housing 10 and welded with the annular wall 13. Compared to a cover in small size being connected with only an edge of the tubular housing opening 12, the cover 30 in the first preferred embodiment has an elongated design to cover and be welded with the annular wall 13, which increases stability and strength of the welded structure and allows the adapter 20 to be limited on the output end of the tubular housing 10 more stably. Also, the annular wall 13 of the tubular housing 10 is allowed to be designed thinner.

Figure 4:
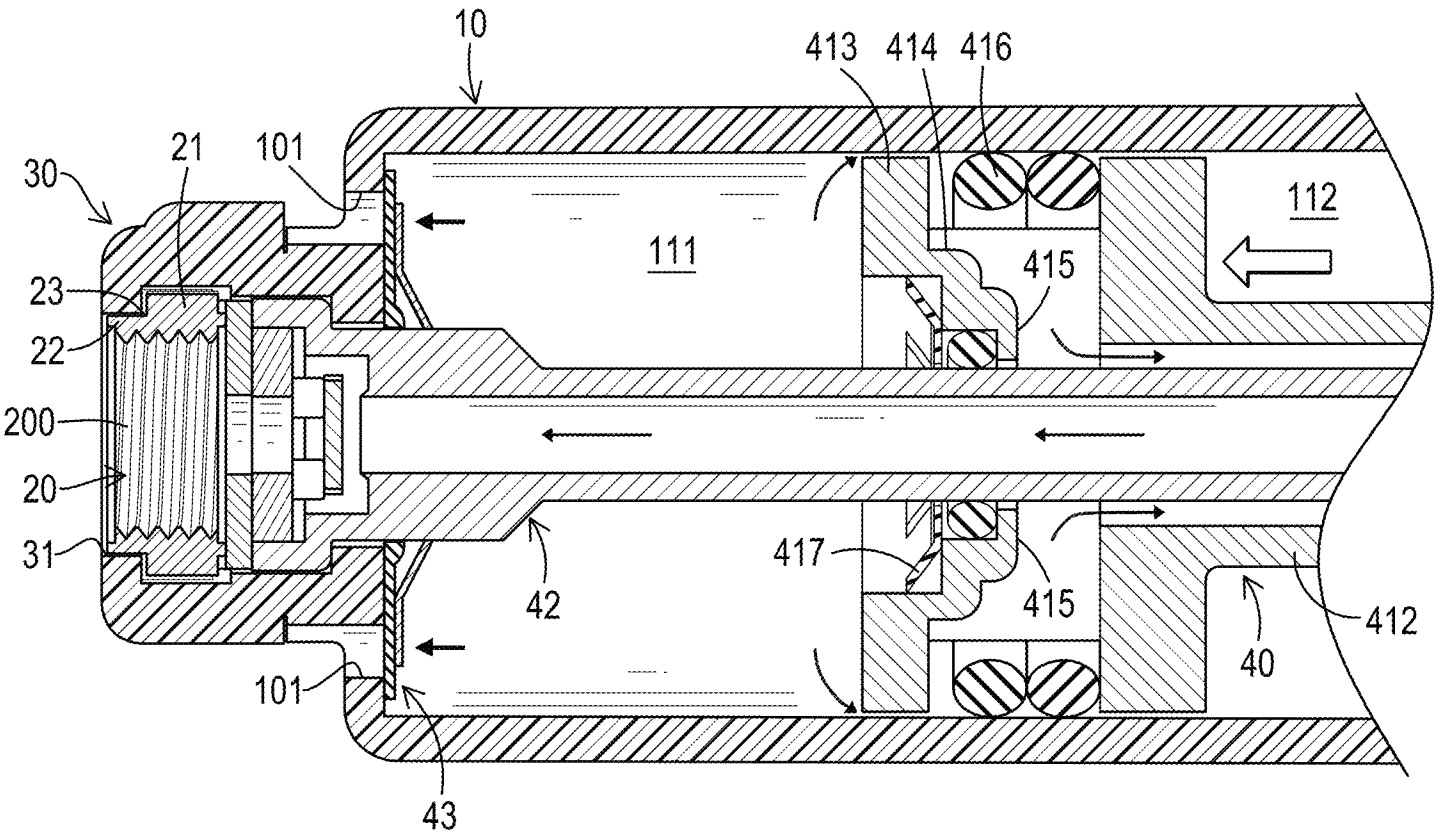
FIGS. 4 and 5 are operational sectional side views of inflation of the inflator in FIG. 1.
Figure 5:
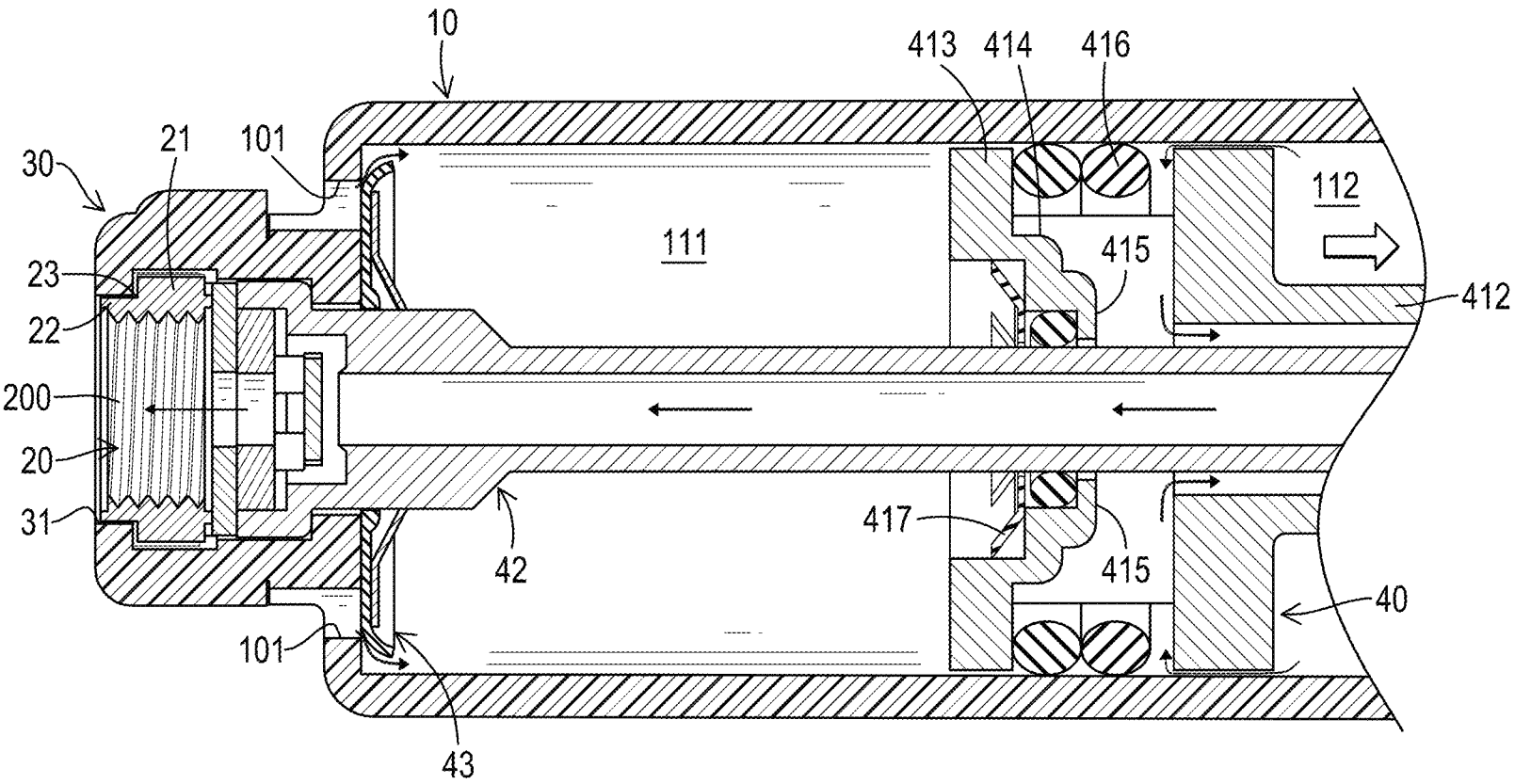

Additionally, with reference to FIGS. 2, 4, and 5, the inflator adopts a structure of a double-acting air pump to inflate objects when operating in two opposite directions. The inflation mechanism 40 has an operating component 41 and an inner tube 42. The operating component 41 has a handle 411, an outer tube 412, and a piston 413. The handle 411 protrudes from the operation end of the tubular housing 10 to be operable by a user. The outer tube 412 is connected to the handle 411 and disposed in a side the tubular housing 10. The piston 413 is connected to an end of the outer tube 412 away from the handle 411.

With reference to FIGS. 4 and 5, the piston 413 divides the interior space into a first chamber 111 and a second chamber 112. The first chamber 111 is defined between the piston 413 and the output end of the tubular housing 10, and the second chamber 112 is defined between the piston 413 and the operation end of the tubular housing 10. The inner tube 42 is fixed inside the tubular housing 10 and near the output end of the tubular housing 10, extending toward the operation end of the tubular housing 10 to be surrounded by the outer tube 412. The spacer for position-limiting of the adaptor 20 is disposed on an end of inner tube 42.

Furthermore, with reference to FIGS. 4 and 5, the operating component 41 of the inflation mechanism 40 has two O-rings 416. The piston 413 is hollow and has an interior communicating with an interior of the outer tube 412. The inflator has two gaps formed between the piston 413 and an inner wall of the tubular housing 10. Each one of the first chamber 111 and the second chamber 112 communicates with the interior of the piston 413 via a respective one of the two gaps. The two O-rings 416 surround the piston 413 and abut the inner wall of the tubular housing 10.

Specifically, the two O-rings 416 are disposed in an annular groove 414 on the piston 413. An interior of the annular groove 414 communicates with the interior of the outer tube 412 via two inner openings 415 spaced from each other. When the outer tube 412 and the piston 413 move, the two O-rings 416 are configured to seal one of the two gaps to achieve efficacy of inflating in both two opposite operating directions. In other embodiments, the inflation mechanism 40 may have check valves between the first chamber 111/the second chamber 112 and the interior of the piston 413.

Specifically, with reference to FIG. 4, when the outer tube 412 and the piston 413 move toward the output end of the tubular housing 10, since the two O-rings 416 abut the inner wall of the tubular housing 10, the two O-rings 416 first abut a side wall of the annular groove 414 and is then driven by the piston 413 such that the gap between the second chamber 112 and the interior of the piston 413 is sealed by the two O-rings 416. At the time, since a volume of the first chamber 111 decreases, air inside the first chamber 111 is driven to flow through the corresponding gap, sequentially enter the interior of the piston 413, the outer tube 412, and the inner tube 42, and then flow to the adaptor 20 due to pressure.

With reference to FIG. 5, when the outer tube 412 and the piston 413 move toward the operation end of the tubular housing 10, the two O-rings 416 also abut the side wall of the annular groove 414 and are then driven by the piston 413. Thence, the gap between the first chamber 111 and the interior of the piston 413 is sealed by the two O-rings 416. At the time, since a volume of the second chamber 112 decreases, air inside the second chamber 112 is driven by pressure to flow through the corresponding gap, sequentially enters the interior of the piston 413, the outer tube 412, and the inner tube 42, and then flows to the adaptor 20.

Also, with reference to FIGS. 2, 4, and 5, the tubular housing 10 has multiple first inlets 101 and multiple second inlets 102. The multiple first inlets 101 communicate with the first chamber 111 and an exterior of the tubular housing 10, and the multiple second inlets 102 communicate with the second chamber 112 and an exterior of the tubular housing 10. The inflation mechanism has a first covering sheet 43 and a second covering sheet 44 respectively disposed near the multiple first inlets 101 and multiple second inlets 102.

When the outer tube 412 and the piston 413 move toward the output end of the tubular housing 10, the volume of the first chamber 111 decreases such that air inside the first chamber 111 pushes the first covering sheet 43 to cover the multiple first inlets 101, and air outside the tubular housing 10 pushes away the second covering sheet 44 and enters the second chamber 112 from the multiple second inlets 102.

When the outer tube 412 and the piston 413 move toward the operation end of the tubular housing 10, the volume of the second chamber 112 decreases such that air inside the second chamber 112 pushes the second covering sheet 44 to cover the multiple second inlets 102, and air outside the tubular housing 10 pushes away the first covering sheet 43 and enters the first chamber 111 from the multiple first inlets 101. Hence, the inflator can operate as a double-acting air pump and maintain balance of pressure at the same time.

Besides, with reference to FIGS. 4 and 5, in the preferred embodiment, the operating component 41 has a seal ring and a piston sheet 417. With reference to FIG. 4, the seal ring is an O-ring. The seal ring is tightened on the inner tube 42 and has a periphery abutting an inside wall of the piston 413 to prevent air from flowing through a gap between the inner tube 42 and the piston 413 and flowing into the interior of the piston 413. The piston sheet 417 is connected with the piston 413 and limits the seal ring inside the piston 413. Thus, air is limited to flow only through said gaps between the piston 413 and the inner wall of the tubular housing 10.

Figure 6:
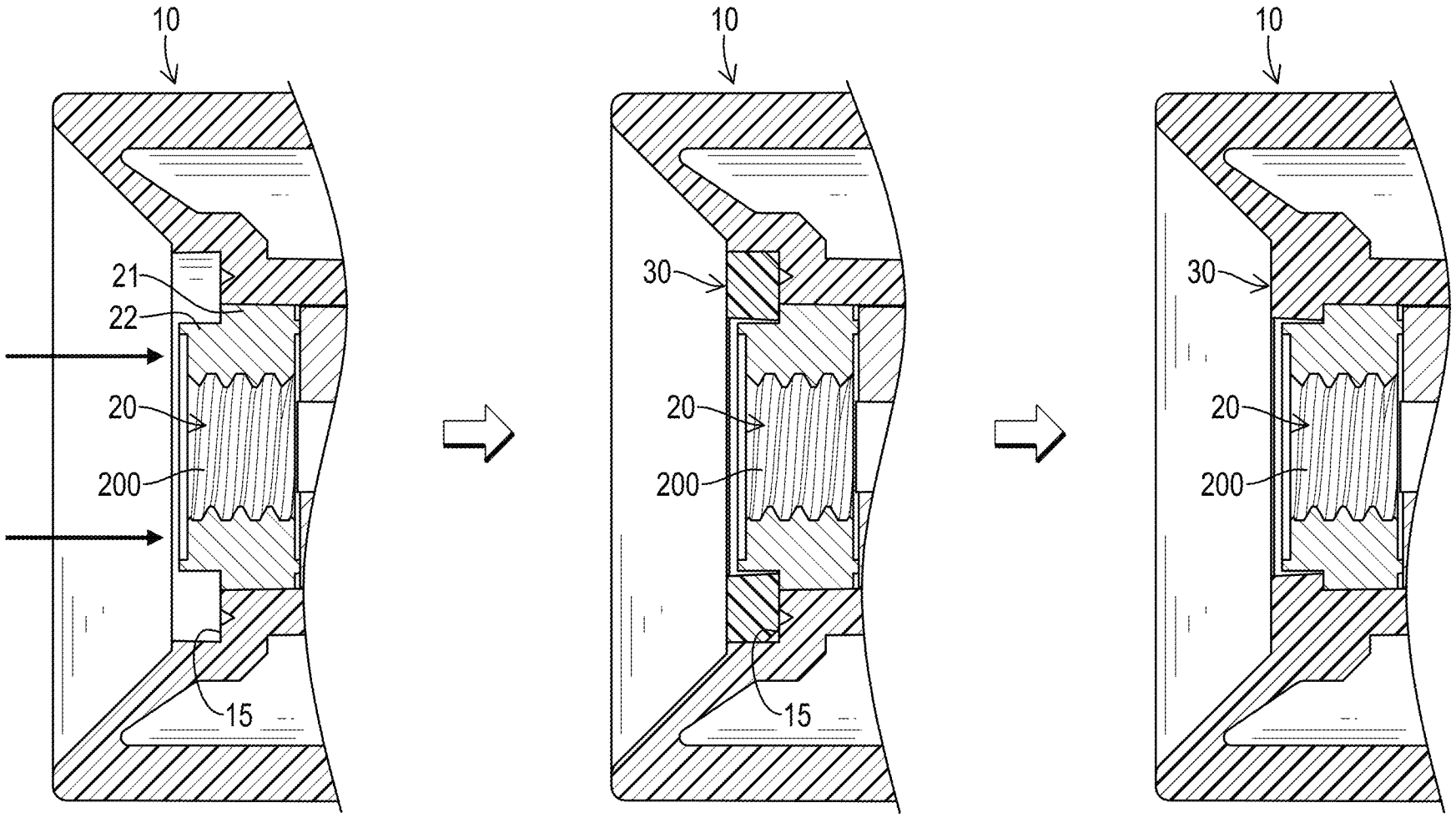
FIG. 6 is an enlarged operational sectional side view of connecting the cover with the tubular housing of a second preferred embodiment of the inflator in accordance with the present invention.
Figure 7:
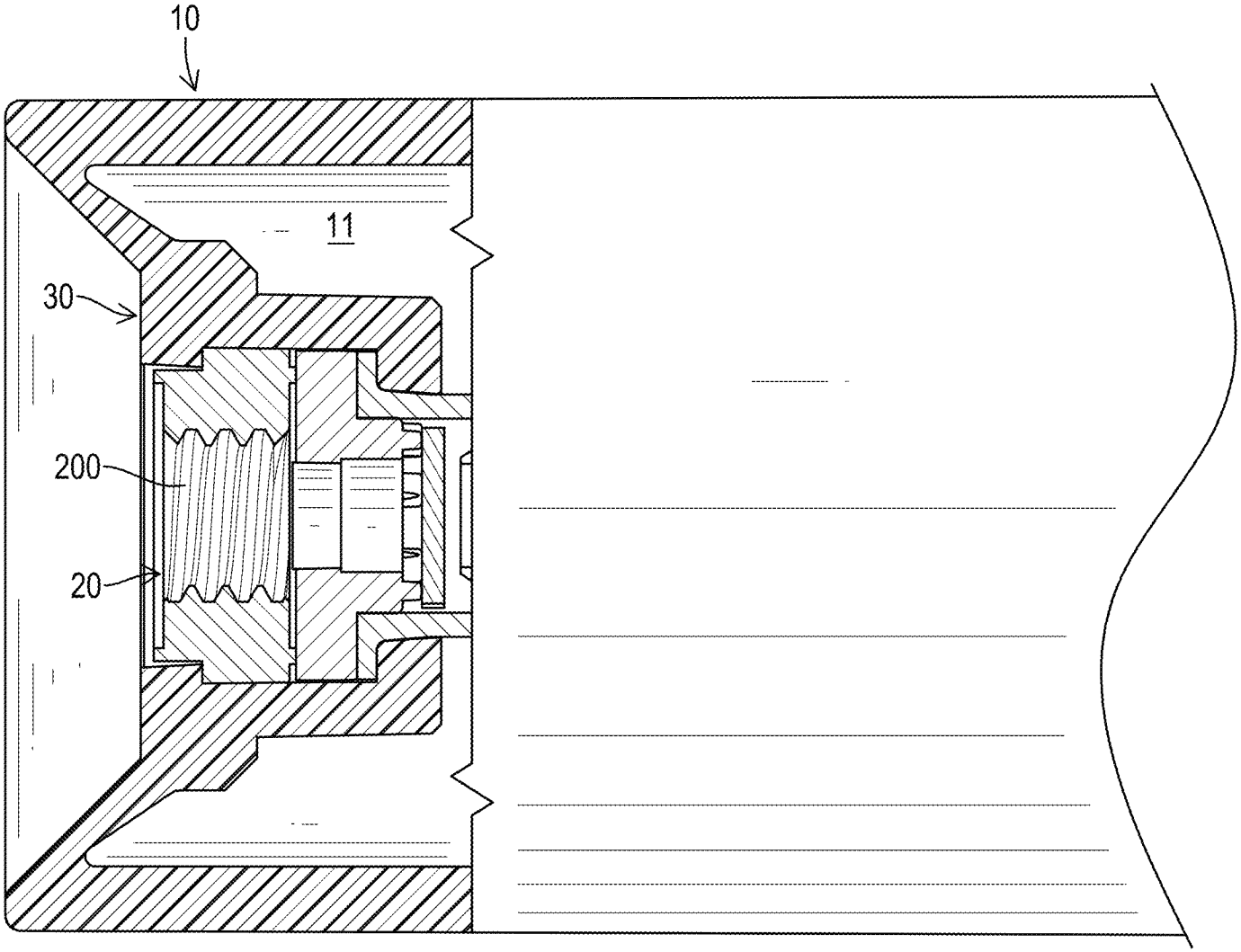
FIG. 7 is an enlarged side view of the inflator in FIG. 6 in partial section.
Figure 8:
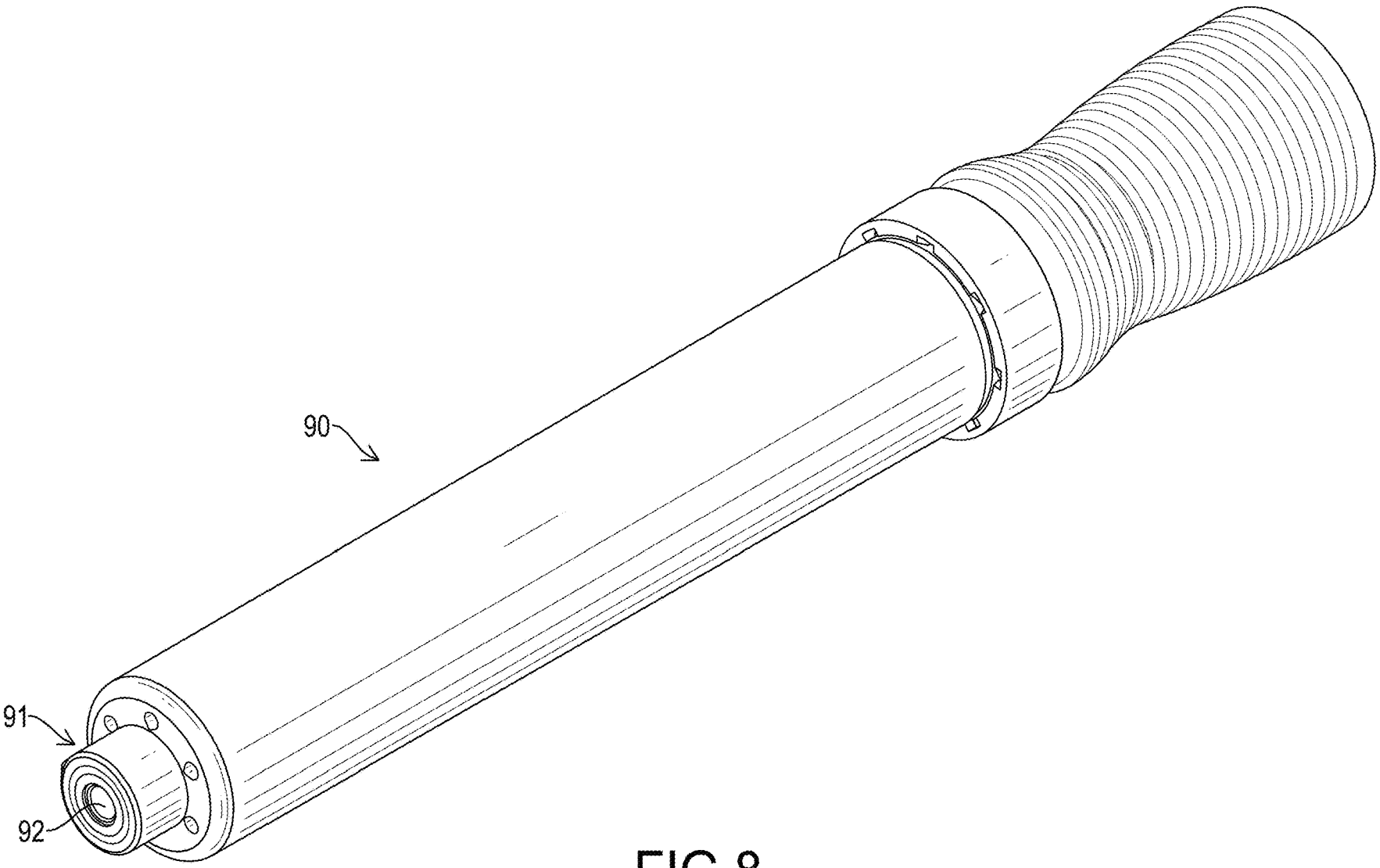
FIG. 8 is a perspective view of a conventional inflator in accordance with the prior art.
Figure 9:
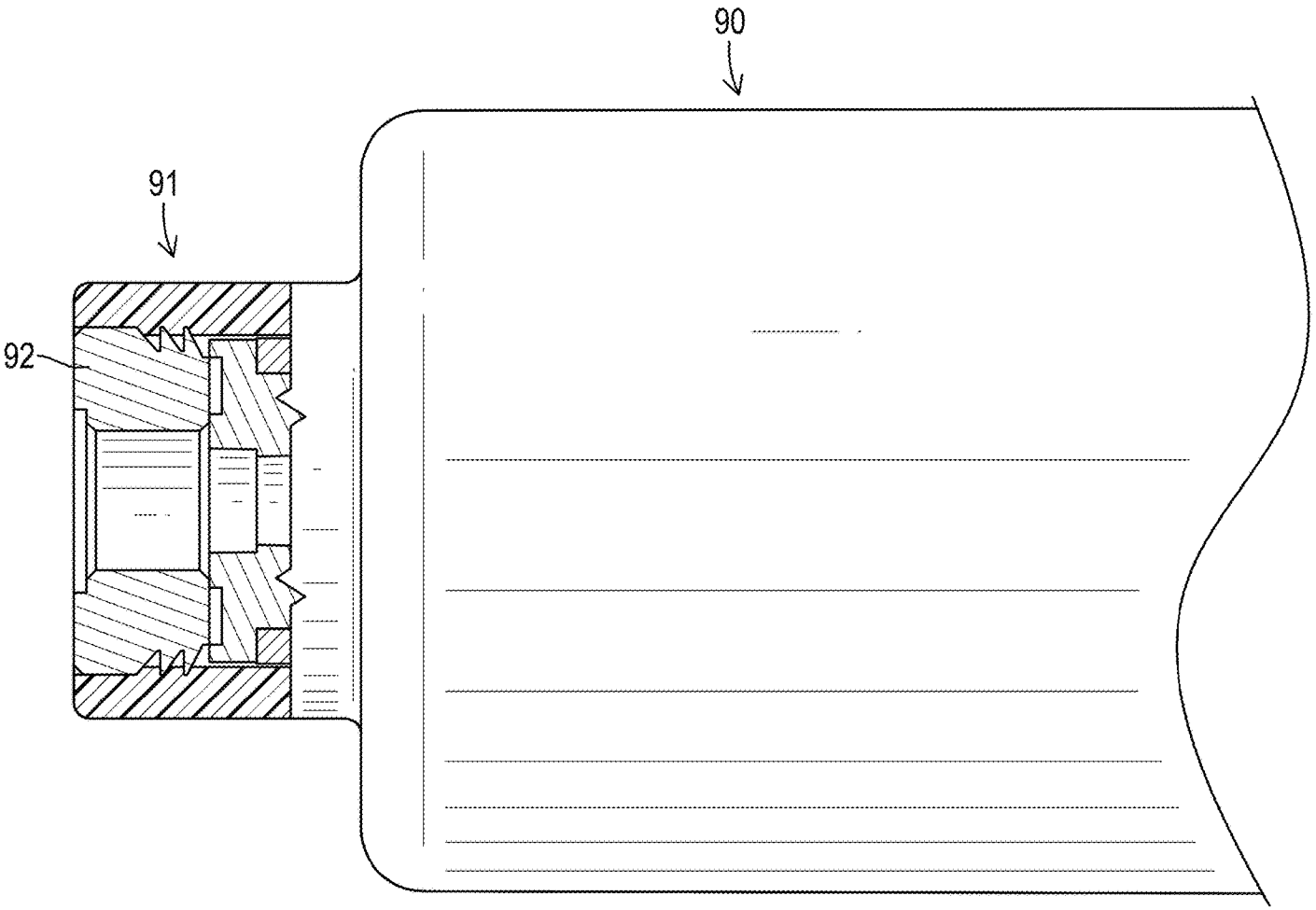
FIG.9 PRIOR ART
FIG. 9 is a partially sectional and enlarged side view of the conventional inflator in FIG. 8.

With reference to FIGS. 6 and 7, a second preferred embodiment of the inflator in accordance with the present invention differs from the first preferred embodiment in that: the output end of the tubular housing 10 adopts a concave design and has a recess. The adaptor 20 and the cover 30 are disposed inside the recess. Specifically, the tubular housing 10 has a groove 15 formed on the output end and inside the recess. An interior of the groove 15 communicates with the recess and the interior space 11 of the tubular housing 10.

When assembling, the adaptor 20 is first placed in the tubular housing 10 from the recess such that the first cylindrical post portion 21 is disposed in the tubular housing 10 and the second cylindrical post portion 22 is disposed in the interior of the groove 15. Afterwards, the cover 30 is welded with the tubular housing 10 in the interior of the groove to surround a periphery of the second cylindrical post portion 22 and limit the first cylindrical post portion 21 inside the tubular housing 10. The adaptor 20 can be limited between the cover 30 and the inflation mechanism 40 as the first preferred embodiment. Thereby, the second preferred embodiment of the inflator in accordance with the present invention also provides position-limiting efficacy as well.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inflator comprising:

a tubular housing made of plastic, having a first end and a second end opposite to each other, and being hollow to form an interior space;

an adaptor made of metal and disposed on the tubular housing;

a cover made of plastic and welded with the tubular housing to limit the adaptor on the first end of the tubular housing; and an inflation mechanism disposed to the interior space and being operable to pump air to flow from the interior space to an exterior of the tubular housing through the adaptor; wherein the adaptor has a first cylindrical post portion and a second cylindrical post portion connected to each other, the first cylindrical post portion has an outer diameter larger than an outer diameter of the second cylindrical post portion;

the cover has an opening having a diameter smaller than the outer diameter of the first cylindrical post portion and larger than the outer diameter of the second cylindrical post portion, the second cylindrical post portion is inserted in the opening of the cover;

the first cylindrical post portion is limited in the tubular housing by the cover;

the tubular housing has a tubular housing opening and an annular wall surrounding the tubular housing opening on the first end of the tubular housing;

the first cylindrical post portion of the adaptor is disposed in the tubular housing and surrounded by the annular wall, and the second cylindrical post portion of the adaptor protrudes from the tubular housing opening to be inserted in the opening of the cover.

2. The inflator as claimed in claim 1, wherein the cover is sheathed onto the annular wall and welded with the annular wall.

3. The inflator as claimed in claim 2, wherein the inflation mechanism has an inner tube fixed in the tubular housing;

an outer tube surrounding the inner tube; and a piston connected to the outer tube and dividing the interior space of the tubular housing into a first chamber and a second chamber; and the outer tube and the piston are configured to move back and forth in the tubular housing to pump air to flow from one of the first chamber and the second chamber into the outer tube, into the inner tube, and to the adaptor sequentially.

4. The inflator as claimed in claim 3, wherein the piston is hollow and has an interior communicating with an interior of the outer tube;

the inflator has two gaps formed between the piston and an inner wall of the tubular housing;

each one of the first chamber and the second chamber communicates with the interior of the piston via a respective one of the two gaps; and the inflation mechanism has at least one O-ring surrounding the piston, abutting the inner wall of the tubular housing, and being drivable by the piston to seal one of the two gaps.

5. The inflator as claimed in claim 1, wherein the tubular housing has a groove formed on the first end of the tubular housing;

the groove has an interior communicating with the interior space of the tubular housing;

the first cylindrical post portion of the adaptor is disposed in the tubular housing;

the second cylindrical post portion of the adaptor is disposed in the groove; and the cover is connected in the groove, surrounds the second cylindrical post portion of the adaptor, and limits the first cylindrical post portion of the adaptor in the tubular housing.

6. The inflator as claimed in claim 5, wherein the inflation mechanism has an inner tube fixed in the tubular housing;

an outer tube surrounding the inner tube; and a piston connected to the outer tube and dividing the interior space of the tubular housing into a first chamber and a second chamber; and the outer tube and the piston are configured to move back and forth in the tubular housing to pump air to flow from one of the first chamber and the second chamber into the outer tube, into the inner tube, and to the adaptor sequentially.

7. The inflator as claimed in claim 6, wherein the piston is hollow and has an interior communicating with an interior of the outer tube;

the inflator has two gaps formed between the piston and an inner wall of the tubular housing;

each one of the first chamber and the second chamber communicates with the interior of the piston via a respective one of the two gaps; and the inflation mechanism has at least one O-ring surrounding the piston, abutting the inner wall of the tubular housing, and being drivable by the piston to seal one of the two gaps.

8. The inflator as claimed in claim 1, wherein the inflation mechanism has an inner tube fixed in the tubular housing;

an outer tube surrounding the inner tube; and a piston connected to the outer tube and dividing the interior space of the tubular housing into a first chamber and a second chamber; and the outer tube and the piston are configured to move back and forth in the tubular housing to pump air to flow from one of the first chamber and the second chamber into the outer tube, into the inner tube, and to the adaptor sequentially.

9. The inflator as claimed in claim 8, wherein the piston is hollow and has an interior communicating with an interior of the outer tube;

the inflator has two gaps formed between the piston and an inner wall of the tubular housing;

each one of the first chamber and the second chamber communicates with the interior of the piston via a respective one of the two gaps; and the inflation mechanism has at least one O-ring surrounding the piston, abutting the inner wall of the tubular housing, and being drivable by the piston to seal one of the two gaps.

* * * * *